US005727268A

United States Patent [19]

Tilmans

[11] Patent Number: 5,727,268

[45] Date of Patent: Mar. 17, 1998

[54] SOFT EDGING FOR A WATER BED

[76] Inventor: Etienne Tilmans, Bosstraat 13, 3941 Eksel, Belgium

[21] Appl. No.: 740,293

[22] Filed: Oct. 25, 1996

[30] Foreign Application Priority Data

Oct. 27, 1995 [EP] European Pat. Off. ..... 95870118

[51] Int. Cl.[6] ..... A47C 19/00; A47C 27/08

[52] U.S. Cl. ..... 5/680; 5/678

[58] Field of Search ..... 5/669, 680, 678, 5/679, 681, 400

[56] References Cited

U.S. PATENT DOCUMENTS 4,057,862 11/1977 LaBianco ..... 5/679
4,186,452 2/1980 Underwood ..... 5/400
4,389,741 6/1983 Larson ..... 5/669
5,203,040 4/1993 Hochschild, III ..... 5/680

FOREIGN PATENT DOCUMENTS 9007892 7/1990 WIPO ..... 5/400

*Primary Examiner*—Alexander Grosz

[57] ABSTRACT

A soft edging for a water bed formed by a hollow profile having two sides directed towards each other. The uppermost of these sides is an inwardly and downwardly directed surface which supports a foam rail. The lowermost of these sides is configured at an angle relative to a plate defining therebetween a continuous hollow space. A wedging-shaped component, connected to the foam rail by a flexible material, such as a strip of textile is clamped in the continuous hollow space.

15 Claims, 6 Drawing Sheets

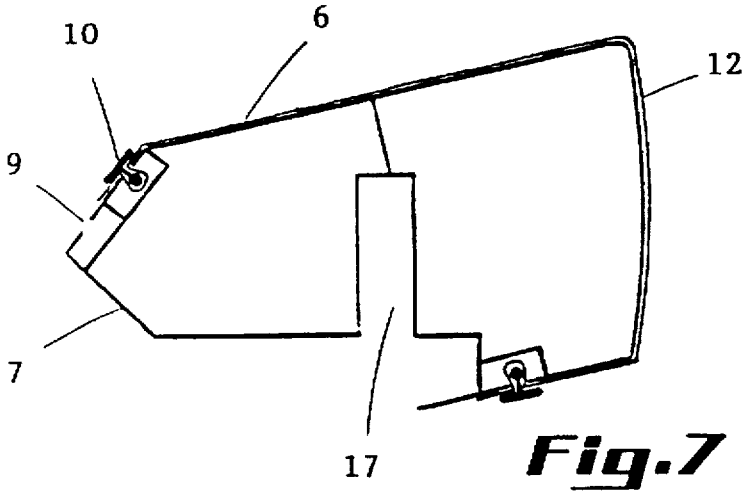
Fig.7
Fig.9
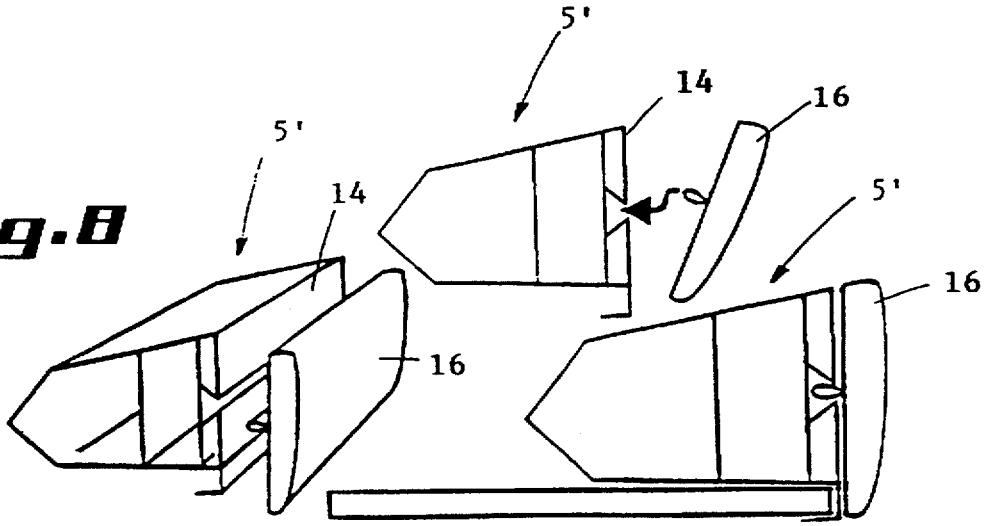
Fig.8
Fig.10

SOFT EDGING FOR A WATER BED

RELATED APPLICATION

This application claims priority of European Patent Application No. EP-95870118.7 filed Oct. 27, 1995, which is incorporated herein by reference.

BACKGROUND OF THE INVENTION

The invention relates to a soft edging for a water bed consisting mainly of a base with a bed plate thereon on which the water mattress is placed.

The object of the invention is to design an edging for a water bed which improves the comfort when getting in and out while at the same time a convenient space is provided for inserting sheets and blankets relative to the water bed.

SUMMARY OF THE INVENTION

To enable this according to the invention an edging for a water bed is formed as a hollow profile or extrusion having two opposed sides directed towards each other. The upper surface of the profile is configured in an inwardly and downwardly direction and a foam rail, which forms a soft edge for the water bed, rests on the upper surface of the profile. The lower of the two surfaces of the profiles rests partially on the bed plate and a continuous, hollow space is defined between the bed plate and a portion of the lower surface of the profile. A a wedgeshaped component, which may be connected to said foam rail by a flexible material, such as a strip of textile, can be clamped in the hollow space.

According to the invention, two textile sleeves are provided; the foam rail consists of a flexible material enclosed in the first textile sleeve which extends over an inwardly directed upper surface of said profile. The wedge component is positioned in the second sleeve and the two sleeves may be connected together.

In a preferred embodiment, along one end of the water bed which corresponds to the "headboard", the soft edging includes an intermediate "adapter" so that the soft edging is spaced a distance from the headboard.

Other details and advantages of the present invention will become apparent from the following detailed description of a soft edging for a water bed according to the invention. This description is only given by way of example and does not limit the invention.

BRIEF DESCRIPTION OF THE DRAWINGS

The reference numerals relate to elements shown in the figures annexed hereto. In the figures:

FIGS. 6 and 7 show a cross sectional view of the profile according to the invention and two fastener means for the upholstery of this profile.

FIGS. 8, 9 and 10 illustrate finishing possibilities of the profile according to the invention.

DETAILED DESCRIPTION OF THE PREFERRED EMBODIMENTS

Figure 1:
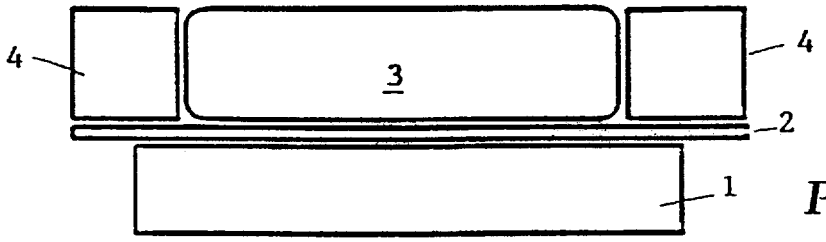
Fig. 1 Prior Art
FIGS. 1 to 4 show schematically a series of embodiments pertaining to the known state of the art.
Figure 2:
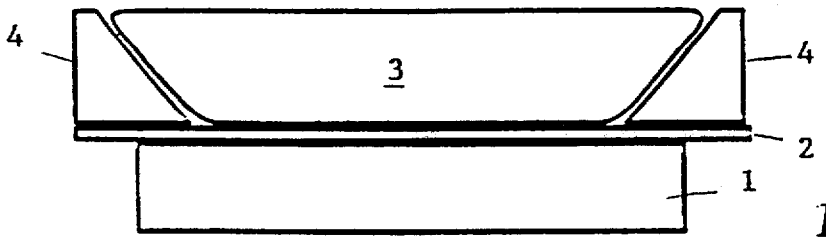
Fig. 2 Prior Art
Figure 3:
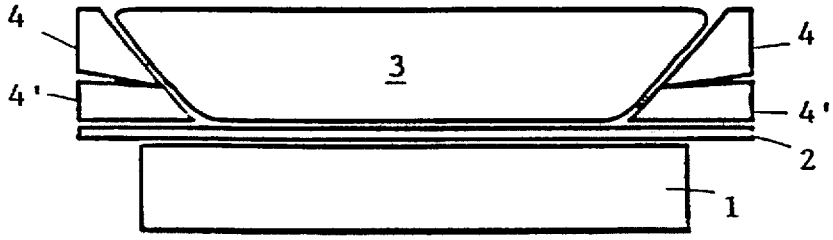
Fig. 3 Prior Art
Figure 4:
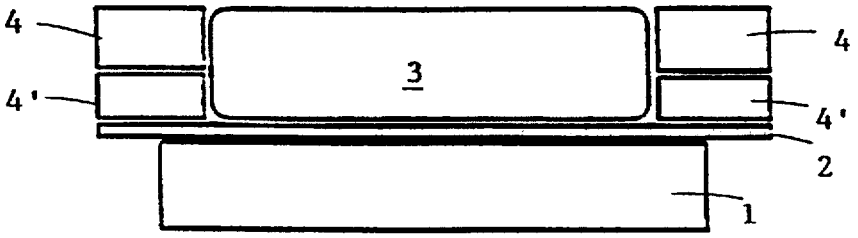
Fig. 4 Prior Art

The soft edging for a water bed shown in these Figures rests on a generally rectangular plate 2 which, in turn, is positioned on a base or socle 1 in a usual manner. Base or socle 1 and plate 2 do not pertain to the essence of the invention and can therefore have different structures.

Upon referring now to known embodiments pertaining to the state of the art according to FIGS. 1 to 4, it will be noticed that the so-called soft edges for a water mattress 3 never solve at the same time the problem of comfort for the user of the water bed and ease and convenience for securing sheets and blankets. The soft edging for a water bed according to the prior art is formed by the presence of continuous blocs 4 around the periphery of the mattress. If necessary, blocs 4 can be positioned on blocs 4' which surround the periphery of the mattress. The blocs 4, 4' can be made from a more or less soft deformable elastic material or a non-resilient material.

The present invention proposes the use of an extrusion or profile 5 the external form, the internal structure and the cross profile or cross section of which clearly become apparent from the FIGS. 6 to 14.

Figure 5:
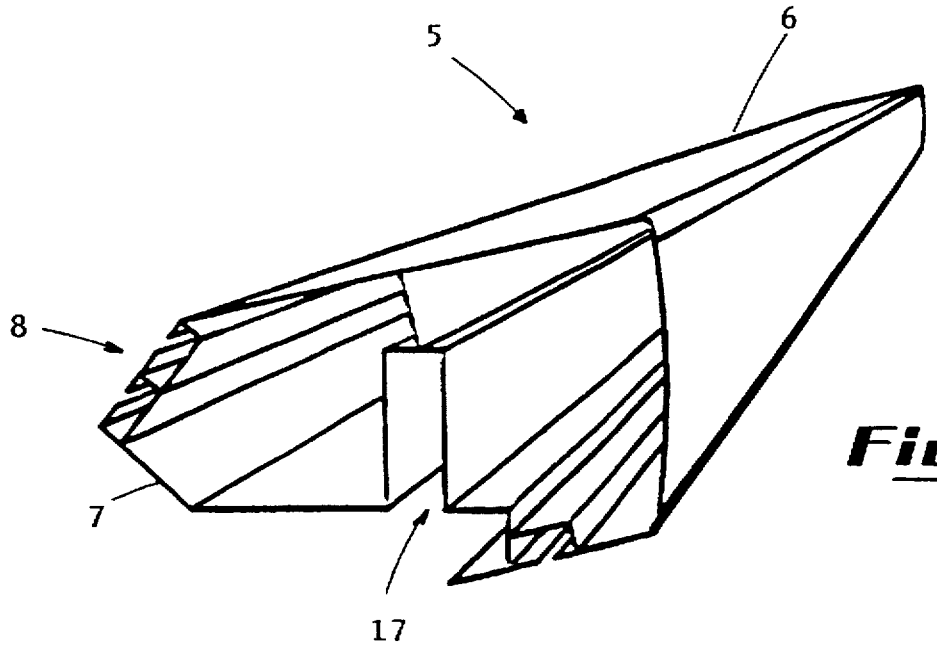
FIG. 5 is a perspective view of the profile which is a part of the soft edging according to the invention.
Figure 6:
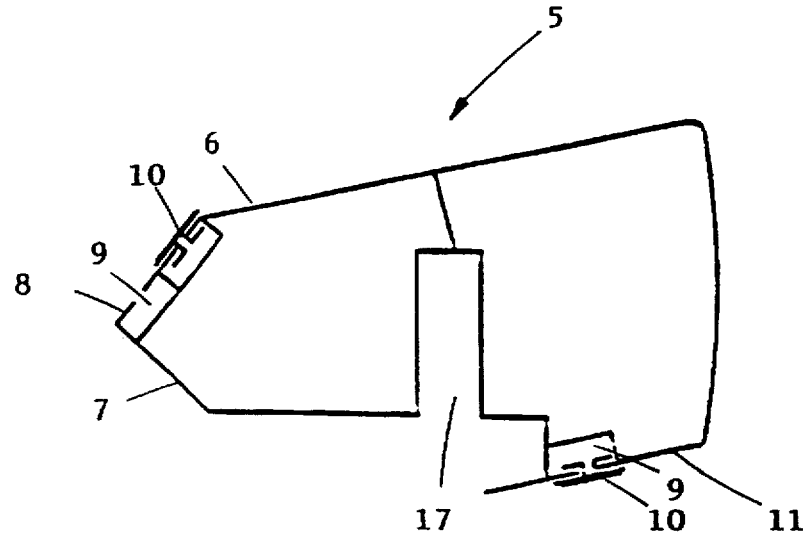

Referring first to FIGS. 5 and 6, the profile 5 has a polygonal cross-section and has inter alia, an upper side 6 and a lower side 7 generally directed or angled towards each other. A side 8 connects sides 6 and 7 to each other, and side 8 is situated with at least one, but preferably two or more continuous grooves 9 into which an auxiliary profile 10 can be slid and held in place such as with a hook and loop fastener.

The profile 5 includes a lower side 11 which may be generally parallel to upper side 6 and a similar groove 9, for a second auxiliary profile 10 provided in the lower side 11 of the profile 5. Since the profile is to be provided or covered with a textile upholstery 12, (FIG. 7) this upholstery can easily be connected to the hook and loop fasteners of the two auxiliary profiles.

According to FIG. 7, a modified auxiliary profile 13 is used which can clamp the upholstery 12 in the groove 9 without having to use a hook and loop fastener. End caps 24 (FIG. 16) are provided and the end caps match the cross-sectional configuration of the profile. Thus when the profiles are covered with upholstery which is first folded inwards at the ends of the profiles, then the caps 24 are forced into the ends of the profiles to secure or clamp the upholstery in the profile. In the corners they join each other under an angle of 45°.

An alternate configuration of the profile is illustrated in FIGS. 8, 9 and 10 wherein a profile 5' has an outwardly directed side 14 (i.e., remote from the mattress). A continuous slot 15 with a swallow's tail shaped cross section is provided in the outwardly directed side 14 of the profile 5' and finishing panels 16 can be snap-fit into the continuous slot 15 to enhance the outward appearance of the profiles 5'.

Figure 16:
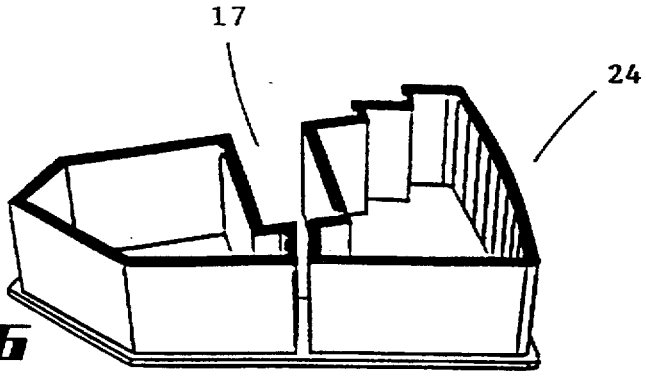
FIG. 16 is a perspective view of a cap for closing the ends of the profiles according to the invention.
Figure 17:
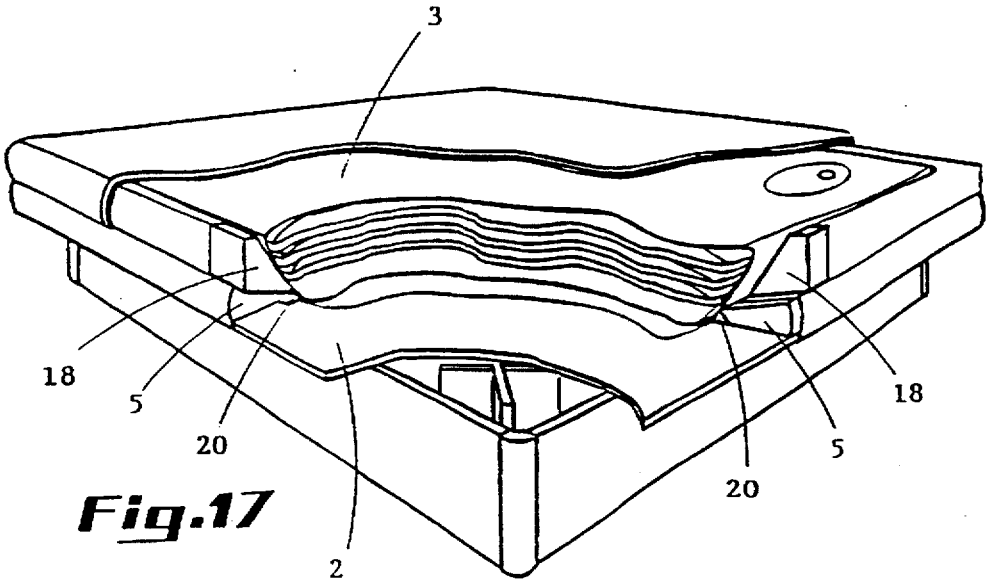
FIG. 17 shows on a very reduced scale a partially cutaway perspective view of a water bed with a soft edging according to the invention.

Referring back to FIGS. 5 and 6, and, in addition, referring to FIGS. 7 and 11 through 14, the profile 5 includes a hollow chamber 17 or slot extending in the longitudinal direction thereof, which can be slid over a vertical base socle 25 of a water bed. A corresponding chamber or slot 17 is provided in the end caps 24. (FIG. 16). Profile 5 can be immobilized with respect to the verticle base socle 25 and the profile is supported from underneath because the profile rests on the plate 2.

Figure 11:
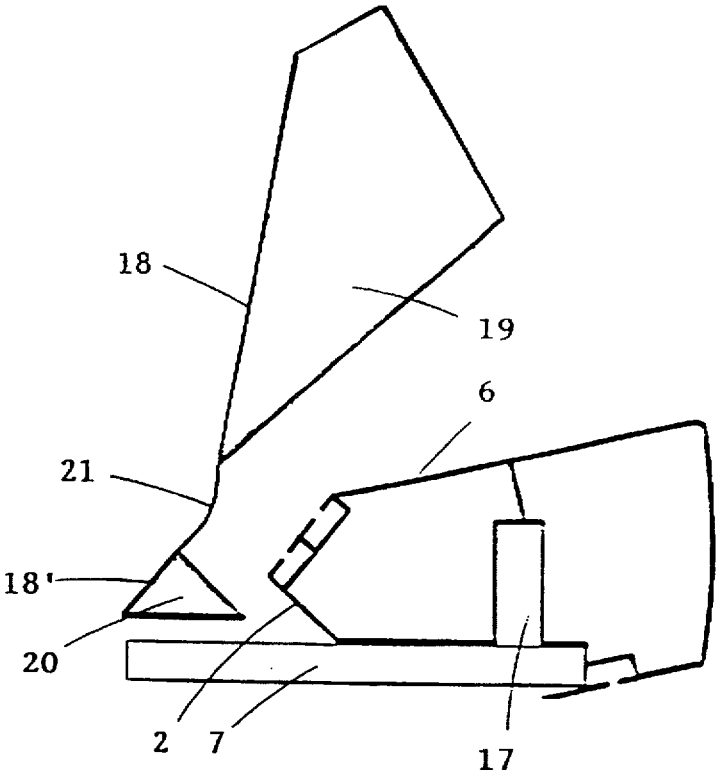
FIGS. 11 and 12 show a cross sectional view of the profile according to the invention and the soft edging pertaining thereto, with the soft edging partially spaced away from the profile in FIG. 11 for illustrative purposes.
Figure 12:
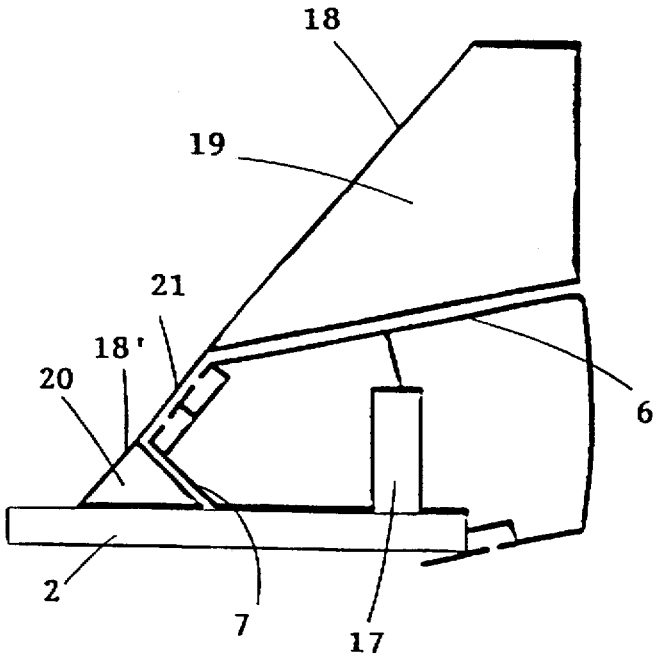
Figure 13:
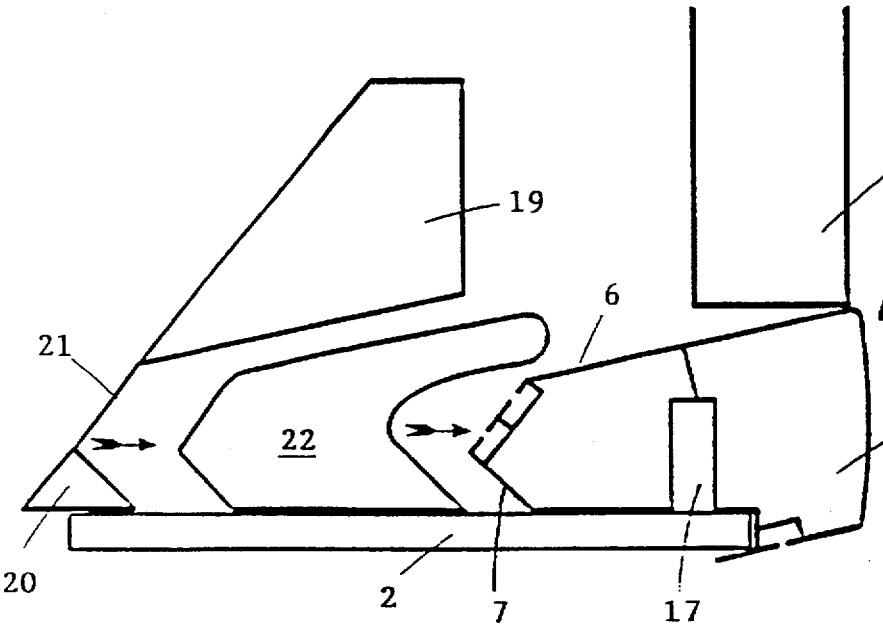
FIGS. 13 and 14 show a cross sectional view of the profile according to the invention and the soft edging (and "adapter") pertaining thereto according to the invention with the soft edging and adapter partially offset from the profile in FIG. 13 for illustrative purposes.
Figure 14:
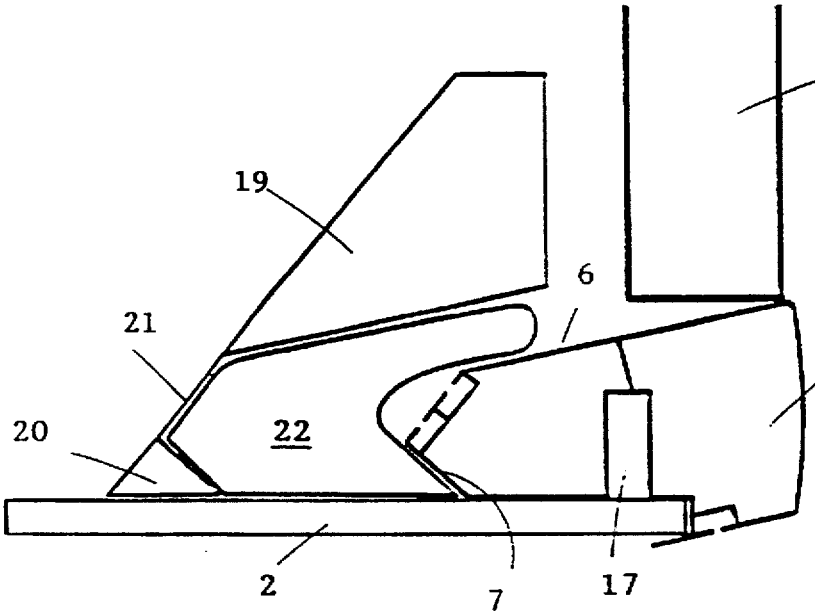
Figure 15:
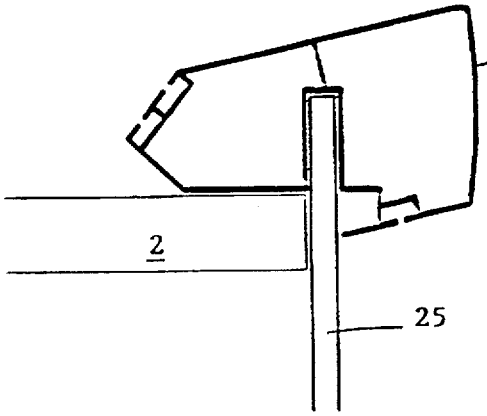
FIG. 15 shows schematically the connection between a profile according to the invention and a vertical socle of the water bed.

FIGS. 11 and 12 illustrate additional important features and benefits of the present invention. As noted previously, the profile 5 enables the user to provide a soft edging around the periphery of the water bed. The soft edging improves the comfort of the bed. Furthermore, according to the present invention, mounting or positioning the edging, and inserting a mattress protector, sheets and blankets, are simplified.

Specifically, two sleeves 18, 18', formed of a textile material, are provided and the two sleeves are interconnected by a textile strip 21 which functions as a hinge component. A polygonal foam rail 19 is inserted in sleeve 18. A wedge or triangle shaped component 20 is inserted within sleeve 18'. The foam rail 19 and wedge component 20 are capable of hinge movement relative to each other because of the textile strip 21. The foam rail 19 (within sleeve 18) is positioned on the top 6 of the profile 5. The wedge component 20 (within sleeve 18') is forced into the space which is created between the plate 2 and the upwardly inclined surface 7 of the profile 5. This wedging action conveniently maintains the foam rail 19 in proper position on profile 5.

It should be appreciated that the arrangement of the foam rail 19 as just described may be used on all four sides of a water bed. However, if the water bed includes a headboard, an alternate arrangement may be preferred. Specifically, referring to FIGS. 13 and 14, the foam rail 19 and wedging-shaped component 20 which are connected as if by means of hinges connected to each other, can be used in combination with an adapter 22 along the side of the water bed adjacent the headboard 23. The adapter has a cross-section which includes a first portion to rest on the plate 2, a second portion to receive the wedging component 20, a third portion on which the textile strip 21 is positioned, a fourth portion upon which the foam rail 19 is supported, and a fifth or curved portion which rests on both the sides 6 and 7 of the profile 5.

The foregoing is a complete description of the invention. Various changes and modifications may be made without departing from the spirit of the invention. The present invention provides a soft edging which increases the comfort of the bed and improves considerably the insertion of mattress protectors, sheets and blankets. The invention should be limited only by the scope of the following claims.

What is claimed is:

1. A soft edging for a water bed, the water bed generally including a base plate having a water mattress thereon, characterized by:

a hollow profile having at least first, second and third sides, the third side angled upwardly from said base plate;

a first side resting on said base plate, the uppermost of the second and third sides defining a first support surface;

a continuous hollow space defined between the lowermost of the second and angled third sides and the base plate; and said second and third sides converge toward each other, a foam rail supported on said first support surface;

a wedging member secured in said hollow space; and said foam rail and said wedging member being hingedly interconnected.

2. The soft edging according to claim 1 wherein said second side defines an inwardly and downwardly directed surface.

3. The soft edging according to claim 1 wherein said foam rail is positioned within a sleeve.

4. The soft edging according to claim 3 wherein said sleeve extends over one side of said profile.

5. The soft edging according to claim 3 wherein said wedging member is positioned in a second sleeve.

6. The soft edging according to claim 5 wherein a flexible member connects said second sleeve to said first sleeve.

7. The soft edging according to claim 1 wherein said profile includes a fourth side, and said hinged interconnection contacts said fourth side.

8. The soft edging according to claim 1 wherein at least one side of said profile includes a groove for receiving a second profile.

9. The soft edging according to claim 1 wherein said profile includes at least one slot to receive a vertical socle.

10. The soft edging according to claim 1 wherein said profile includes a groove to receive a finishing panel.

11. The soft edging according to claim 1 wherein, for at least one side of said water bed, the soft edging includes an adapter positioned between the foam rail and the profile.

12. The soft edging according to claim 1 and further including an end cap for closing said profile.

13. A soft edging for a water bed, the water bed generally including a base plate having a water mattress thereon, characterized by:

a hollow profile having at least first, second and third sides;

a first side resting on said base plate, the uppermost of the second and third sides defining a first support surface;

a first continuous hollow space defined between the lowermost of the second and third sides and the base plate;

a foam rail supported on said first support surface;

an adapter positioned between the foam rail and the profile, said adapter having a first portion in said first continuous hollow space;

a second continuous hollow space defined between a portion of the adapter and said base plate;

a wedging member secured in said second hollow space; and said foam rail and said wedging member being hingedly interconnected.

14. The soft edging according to claim 13 and further including an end cap for closing said profile.

15. The soft edging according to claim 13 wherein said foam rail and said wedging member are each positioned in sleeves, said sleeves interconnected by a hinge member which abuts said adapter.

* * * * *